United States Patent [19]

Weststrate et al.

[11] 4,154,290

[45] May 15, 1979

[54] DEVICE FOR COOLING CASTINGS AND FOR TREATING MOULDING SAND

[75] Inventors: Marinus H. Weststrate; Jan Willemsen, both of Lisse, Netherlands

[73] Assignee: Expert N.V., Curacao, Netherlands Antilles

[21] Appl. No.: 850,013

[22] Filed: Nov. 9, 1977

[30] Foreign Application Priority Data

Dec. 17, 1976 [NL] Netherlands ..... 7614082

[51] Int. Cl.[2] ..... B22D 29/00; B02C 17/04

[52] U.S. Cl. ..... 164/404; 241/183

[58] Field of Search ..... 164/131, 404, 5, 344; 366/54, 57, 220, 225, 228, 230; 51/164; 241/173, 174, 176, 177, 182, 183, 284

[56] References Cited

U.S. PATENT DOCUMENTS

| | | | |
|---|---|---|---|
| 1,946,440 | 2/1934 | Herrmann | 51/164 |
| 2,470,315 | 5/1949 | McGehee | 241/178 X |
| 3,191,874 | 6/1965 | Drinkwater et al. | 51/164 X |
| 3,407,511 | 10/1968 | Camm | 366/228 X |
| 3,871,438 | 3/1975 | Vissers et al. | 164/131 X |
| 3,942,644 | 3/1976 | Vissers | 51/164 X |
| 3,998,262 | 12/1976 | Didion | 164/131 |

FOREIGN PATENT DOCUMENTS

| | | | |
|---|---|---|---|
| 1220976 | 7/1966 | Fed. Rep. of Germany | 164/401 |

*Primary Examiner*—Richard B. Lazarus
*Assistant Examiner*—John S. Brown
*Attorney, Agent, or Firm*—John P. Snyder

[57] ABSTRACT

A device for cooling castings and for treating moulding sand comprises a driven, rotatably journalled drum provided with internal catches extending substantially axially between an inlet end and an outlet end of the drum.

For improving the stirring effect of the catches and for avoiding damage of castings and loss of valuable dust from the moulding sand, the catches have a stronger scooping effect near the inlet end than near the outlet end.

5 Claims, 7 Drawing Figures

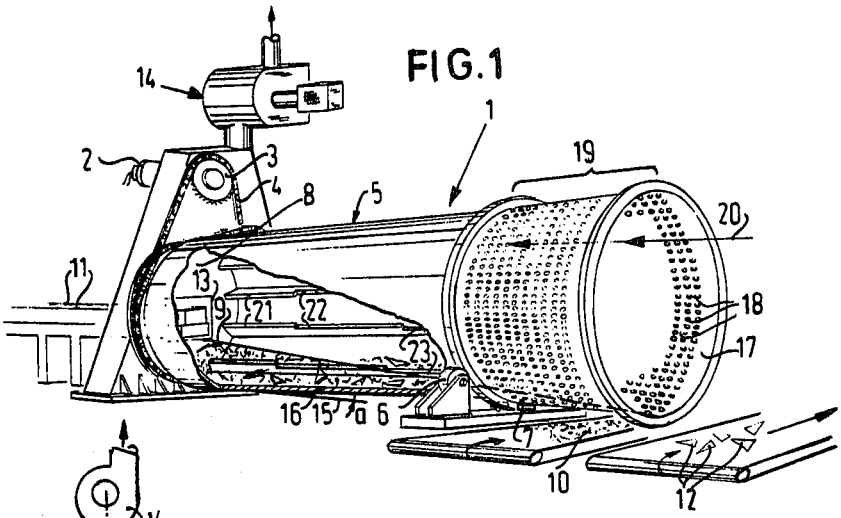
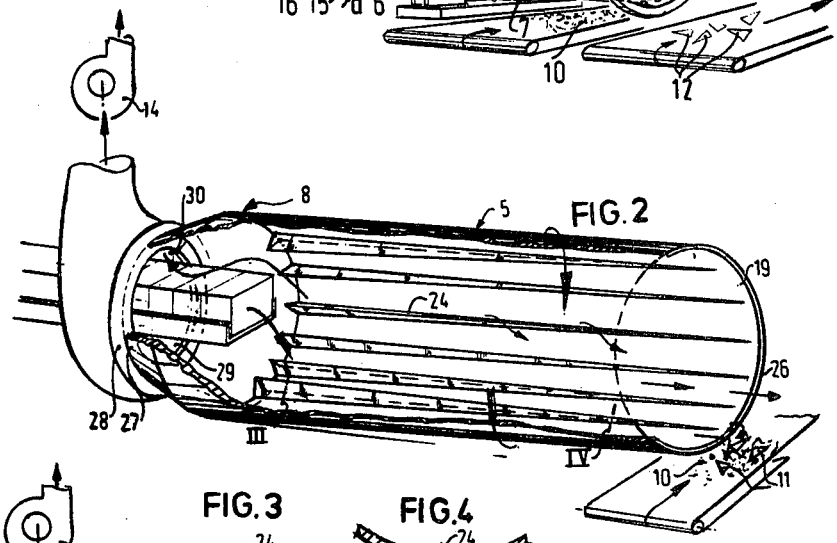
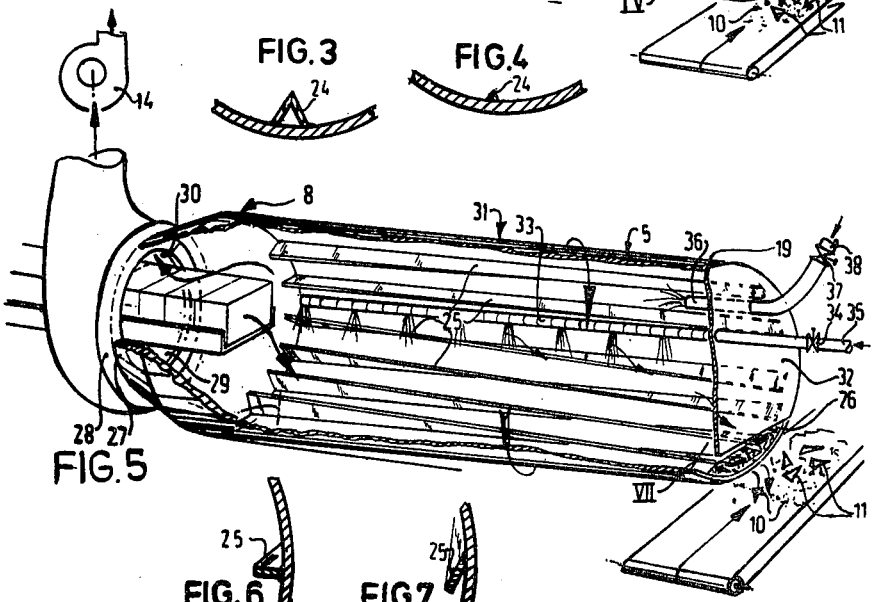
FIG.5
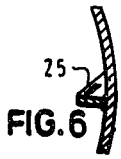
FIG.6
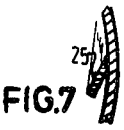
FIG.7

DEVICE FOR COOLING CASTINGS AND FOR TREATING MOULDING SAND

The invention relates to a device for cooling castings and for treating moulding sand, comprising a driven, rotatably journalled drum provided with internal catches extending substantially axially at least between an inlet end and an outlet end of the drum.

A device of the kind set forth is known. In this case the catches have to be low in order to prevent them from excessively lifting castings and moulding sand. Castings lifted to a great height may drop into pieces and moulding sand lifted high is drastically exposed to an air stream passing through the drum, which drags along the fine, but valuable dust from the moulding sand. However, low catches have a minor stirring effect.

The invention has for its object to improve the stirring effect of the catches, whilst avoiding damage of castings and loss of valuable dust from the moulding sand. For this purpose the catches have a stronger scooping effect near the inlet end than near the outlet end.

Viewed in a direction towards the outlet end the height of the catches may decrease or the scooping angle between the drum wall and the catches may increase.

Each catch preferably consists of at least two profiles having different heights.

The invention will be described more fully hereinafter with reference to a drawing.

In the drawing are shown schematically in FIGS. 1, 2 and 5 a perspective side elevation of respectively variants of the device embodying the invention, parts being broken away, in FIGS. 3 and 4 an enlarged sectional view taken on the line III—III and IV—IV respectively in FIG. 2 and in FIGS. 6 and 7 an enlarged sectional view taken on the line VI—VI and VII—VII respectively in FIG. 5.

The device 1 shown in FIG. 1 comprises a drum 5 driven by a motor 2 through a chain sprocket 3 and a chain 4 and being rotatably journalled by means of the chain 4 surrounding the drum 5 and of supporting rollers 6 and 7.

At the inlet end 8 of the drum 5 there is provided a front part 9 having a central entrance 13 for unsheathed moulding forms 11 of normal moulding sand 10 with solidified, but still very hot castings 12 of, for example, 700° C. The outlet end 19 has a cylindrical sieve 18 for passing moulding sand 10 and an outlet 17 for castings 12. The degree of filling of the drum 5 decreases in a direction towards the outlet end 19. The lower generatix 16 extends upwardly in a direction towards the outlet end 19. The angle to the horizontal 15 is, for example, 10°. Near the inlet end 8 the moulding forms 11 are disintegrated and the moulding sand 10 and the castings 12 are mixed up. When the humid moulding sand 10 comes into contact with the castings 12, the moisture of the moulding sand evaporates. The evaporation heat is mainly extracted from the castings and to some extent from the moulding sand 10. By means of a blower 14 communicating with the inlet 13 the evolving vapour is sucked off together with air, which enters the drum 5 in the direction indicated by the arrow 20. Axially extending catches 21, 22 and 23 are distributed along the inner circumference of the drum 5, said catches having, in accordance with the invention, a stronger scooping effect near the inlet end 8 than near the outlet end 19. The catches 21 are each formed by a straight profile. The catches 21 disposed near the inlet end 8 are higher than the catches 22 and the latter are higher than the catches 23 disposed near the outlet end 19. Consequently the catches 21 have the greatest scooping effect. In this case it is not an objection for the moulding sand 10 to be lifted high, since near the inlet end 8 this moulding sand 10 is still very humid, so that there is no risk of dust formation. The fact that the castings 12 are lifted high near the inlet end 8 is not an objection, because the castings 12 dropping from a great height arrive at a thick layer of moulding sand 10. Owing to their appreciable height the catches 21 have an intensive agitating effect on the moulding sand 10 and the castings 12, which highly furthers cooling of the castings 12. On the contrary, the catches 23 have a considerably lower scooping effect and hence a lower agitating effect; they hardly carry castings 12 upwards and the quantity of moulding sand 10 carried upwards is also small so that notable dust formation of the moulding sand 10, which is almost dry at this area, is avoided.

The drum 5 of FIG. 2 is distinguished from that of FIG. 1 in that the catches 24 gradually decrease towards the outlet end 19 rather than stepwise. The catches 24 are formed by triangular plates bent over in the form of a V and being welded in inverted position to the drum 5.

The inlet end 8 has furthermore a front ring 27 turning around a stationary front part 28 having the casting inlet 29 and the air inlet 30 communicating with the blower 14. The drum 5 of FIG. 2 has at its outlet end 19 a common delivery port 26 for cooled castings 12 and moulding sand 10.

The device 31 for regenerating moulding sand and for cooling castings comprises catches 25 gradially more torsioned towards the outlet end 19 so that the scooping effect near the outlet end 19 (see FIG. 7) is appreciably lower than at the inlet end 8 (see FIG. 6).

In the manufacture of castings in metal foundries there is an ever growing tendency to use moulds and cores made from crystal sand bonded with a thermo-hardening synthetic resin. The thermo-hardening synthetic resin is frequently a furan resin obtained from furfuryl alcohol by accelerated curing at 250° C. in the presence of phosphoric acid as a catalyst or otherwise a urea formaldehyde or phenolformaldehyde resin. Such resins have the advantage of providing a satisfactory bond, whilst the moulds satisfactorily remain true to size.

A disadvantage of the synthetic resins is, however, that after the removal of the castings the sand once used still contains much residual synthetic resin and can be regenerated only with difficulty. The synthetic resin forms a hard film around the grains of sand which is removed by combustion. For this purpose the drum 5 of the device 31 has, at the outlet end 19, a stationary partition 32 holding a burner tube 33 communicating through a shut-off member 34 with a gas conduit 35 and an oxygen nozzle 36 communicating through a shut-off member 37 with an oxygen conduit 38.

The device 31 operates in two different ways. On the one hand the sand moulds and cores are ground to loose sand during the revolutions in the vessel by the castings operating as grinding bodies, which has the advantage that grinding requires very little energy, since at the prevailing temperature the binding force of the resin decreases. On the other hand the contact between the hot castings and the grains of sand results in an intensive heat transfer, the sand being heated by the castings at a temperature of about 400° C. This temperature is sufficient to cause spontaneous combustion of the synthetic resin film around the grains of sand. When the vessel is normally filled, the synthetic resin from the sand comes into contact with an adequate quantity of oxygen to ensure complete combustion, but, if necessary, additional oxygen may be introduced through the nozzle 36 into the drum 5. If the heat fed from the castings were not sufficient for maintaining the temperature sufficiently long at the level required for complete combustion, additional heat may be supplied by the burner tube 33. Thus the grains of sand are fully cleaned by the combustion and the gaseous exhaust products are formed substantially solely by carbon dioxide and water vapour. During this treatment the sand is completely dried, which is an additional advantage. The resultant products can be commonly conducted away, then separated and separately cooled, after which the sand is again suitable for making moulds and cores without the need for further treatments.

As an alternative, the resultant mixture of hot castings and hot, regenerated sand may be introduced in common into a cooling drum for further cooling down to ambient temperature, after which the separation is carried out. Such a cooling drum may be of the type defined with reference to FIGS. 1 to 4. The partition 32 has an outlet recess 26. The inlet end 8 is identical to that of FIG. 2.

What we claim is:

1. A device for cooling castings and treating moulding sand, comprising in combination:

an elongate substantially horizontal drum presenting an inlet at one end thereof and an outlet at the opposite end thereof;

means for rotatably supporting said drum for rotation about its longitudinal axis and drive means for rotating said drum;

means for introducing the still hot contents of moulding flasks into said drum through said inlet;

means for creating gas flow through said drum;

the interior of said drum defining a flow path from said inlet to said outlet along which castings and moulding sand are tumbled and intermingled to cool such castings and treat such sand; and rib means on said interior of the drum for effecting a lifting action on said castings and sand which decreases in the direction of said flow path, said rib means comprising a plurality of ribs, each rib being substantially continuous and elongated axially along the axis of the drum, the height of each rib adjacent the inlet end of the drum being greater than its height adjacent the outlet end of the drum whereby each rib generally tapers in the direction from said inlet to said outlet.

2. A device as defined in claim 1 wherein said plurality of ribs are circumferentially spaced and each rib presents stepped heights which sequentially decrease from said inlet to said outlet.

3. A device as defined in claim 1 wherein said plurality of ribs are circumferentially spaced and each rib is of generally triangular shape and disposed to present a continuously decreasing height from said inlet to said outlet.

4. A device as defined in claim 1 wherein said plurality of ribs are circumferentially spaced and each rib is of generally rectangular shape and each being twisted along its length to define, in the rotational direction of said drum, an angle with the interior of the drum which continuously increases from said inlet to said outlet.

5. A device for cooling castings and treating moulding sand, comprising in combination:

a substantially horizontal and elongate drum having an interior surface which supports a mixture of castings and moulding sand such that the depth of the mixture decreases between one end of the drum and the opposite end thereof;

means for introducing the still hot contents of moulding flasks into said one end of the drum and means for rotating said drum about its longitudinal axis whereby to create said mixture of decreasing depth while causing flow thereof toward said opposite end of the drum;

rib means on said interior surface for lifting said castings and sand, in response to rotation of the drum, to heights within said drum which decrease in the direction of flow whereby the castings and sand are agitated less as the depth of said mixture decreases and so that sand fines in the region of opposite end of the drum are not unduly airborne, said rib means comprising a plurality of ribs, each rib being substantially continuous and elongated axially along the axis of the drum, the height of each rib adjacent the inlet end of the drum being greater than its height adjacent the outlet end of the drum whereby each rib generally tapers in the direction from said inlet to said outlet; and means for flowing gas through said drum from said opposite end through said one end thereof whereby to force airborne fines to travel countercurrent to said mixture flow.

* * * * *